US007732043B2

(12) United States Patent
Baig et al.

(10) Patent No.: US 7,732,043 B2
(45) Date of Patent: Jun. 8, 2010

(54) CEILING TILE WITH NON UNIFORM BINDER COMPOSITION

(75) Inventors: Mirza A. Baig, Lindenhurst, IL (US); William A. Schmitt, Duluth, MN (US)

(73) Assignee: USG Interiors, Inc., Chicago, IL (US)

( * ) Notice: Subject to any disclaimer, the term of this patent is extended or adjusted under 35 U.S.C. 154(b) by 1228 days.

(21) Appl. No.: 11/227,014

(22) Filed: Sep. 15, 2005

(65) Prior Publication Data

US 2007/0056705 A1 Mar. 15, 2007

(51) Int. Cl.
*D04H 1/00* (2006.01)
*B32B 5/16* (2006.01)
*D21H 11/00* (2006.01)

(52) U.S. Cl. ..... 428/292.1; 428/323; 162/135

(58) Field of Classification Search ..... 428/323, 428/292.1

See application file for complete search history.

(56) References Cited

U.S. PATENT DOCUMENTS 3,955,031 A 5/1976 Jones et al.
5,320,677 A 6/1994 Baig
5,395,438 A 3/1995 Baig et al.
5,558,710 A 9/1996 Baig
5,911,818 A * 6/1999 Baig ..... 106/698
5,922,447 A 7/1999 Baig
6,268,042 B1 7/2001 Baig
6,443,256 B1 9/2002 Baig
6,616,804 B2 9/2003 Foster et al.
2002/0096278 A1 7/2002 Foster et al.
2003/0079847 A1 5/2003 Howle et al.
2003/0118788 A1 6/2003 Pearce et al.
2004/0209071 A1 10/2004 Carbo et al.

* cited by examiner

*Primary Examiner*—D. Lawrence Tarazano
*Assistant Examiner*—Camie S Thompson
(74) *Attorney, Agent, or Firm*—Pearne & Gordon LLP

(57) ABSTRACT

A ceiling tile product and method in which a slurry formed mat primarily comprising mineral wool and binder is provided with a binder enhancement zone at its face. The binder enhancement zone can reduce the total required latex content, reduce the amount of finish or paint needed to achieve a commercially acceptable color and improve noise reduction.

8 Claims, No Drawings

CEILING TILE WITH NON UNIFORM BINDER COMPOSITION

The invention relates to ceiling tile and, more specifically, to a tile construction that provides improved durability and reduction in manufacturing costs by strategic non-uniform distribution of latex binder through the thickness of the tile.

BACKGROUND OF THE INVENTION

Ceiling tile is frequently manufactured using a felting process to construct a tile or board from a water-based slurry. The slurry, typically, includes a homogeneous mix of all of the raw materials that make up the body proper of the tile. Layers of felted slurry material are pressed into a mat and dried to form a board. Some tiles are constructed from boards that are embossed or patterned before they are completely dry, while others are made from boards that are first dried and then ground to obtain a desired thickness and a smooth finish. Typically, the raw materials include a binder such as latex or starch or a combination of the two that serves to hold the other materials together when the board is dried. Ordinarily, the binder represents a small percentage of the total weight of the board but represents a disproportionately high part of the cost of the materials. The binder content affects board strength and surface hardness. Conventionally, a level of binder content is maintained in the slurry mix to achieve a satisfactory surface hardness and, therefore, acceptable durability.

SUMMARY OF THE INVENTION

The invention provides a ceiling tile construction in which binder material has a non-uniform distribution across the thickness of the tile with a relatively high concentration near the finished or visible face of the tile. The disclosed distribution of binder can reduce manufacturing costs while providing a tile with a satisfactory or even superior surface hardness and durability as well as improved noise absorption capability. The tile of the invention can be made by reducing the binder content in the slurry or mix of material to below heretofore standard formulations and, after the mat or tile board is at least preliminarily formed, including on the side of the mat associated with the future visible face of the tile a layer of supplemental water-based latex binder. The coated binder, preferably, is the same material used in the slurry formulation to fix or cement the other materials making up the tile board. The enhanced binder zone at the visible side of the tile can increase the hardness and strength of the product at this side while allowing total binder content to be reduced, reduce final finish coat or paint requirements and increase sound absorption.

DESCRIPTION OF THE PREFERRED EMBODIMENT

The invention comprises mineral wool-based ceiling tile that, in part, is made in a traditional water felting process. In the context of the present invention, the slurry solids typically contain roughly 90% mineral wool and the remainder of solids primarily comprise binder in the form of latex or latex and starch. All together, the solids in the slurry are about 5% of the total weight of the slurry; i.e. a consistency of 5%. Latex is well-known and widely used commercially as a binder. Normally, the latex is disbursed as a water emulsion and coalesces into a solid when the water is driven off. Various formulations for the slurry can be used as desired or necessary. Generally, the following table gives an approximate range of slurry constituents by weight percentage of total solids:

| | |
|---|---|
| mineral wool | 75-95% |
| perlite | 0-15% |
| cellulose fiber | 0-10% |
| binder (starch) | 0-5% |
| binder (latex) | 0-10% |
| binder (total) | 5-12% |

In the felting process, the slurry is deposited on a moving screen and, typically, is dried by gravity, pressure rolls, vacuum, and heat. The solids in the slurry are generally uniformly mixed and distributed and generally remain or are intended to remain in this state as the mat is formed on the screen and is progressively dried. Preferably, the latex used in the slurry is a high Tg binder material cured at relatively high temperature, for example, by exposing the mat to hot air (for example at about 350° F.) and/or infrared heating. A low Tg binder can be used where it provides sufficient strength and hardness of the core.

The invention comprehends a process and article in which the binder distribution across the thickness of the mat is modified so that a greater concentration of the binder exists adjacent the face or ultimate room side of the ceiling tile. It has been discovered that in practicing the invention, the durability of the ceiling tile, its noise reduction coefficient (NRC) and its finish paint requirements can all be improved even while reducing its total binder content and, therefore, reducing its cost of manufacture.

The increased concentration of latex binder at a latex binder enhancement zone, can be produced by conventional coating techniques such as by spraying, roll-coating, flood coating and the like. The binder enhancement zone, when made by a coating process, can be coated before, during, or after the slurry formed mat is dried and/or cured. Prior partial or full curing of the mat can reduce or prevent free migration of the binder material being applied to form the enhancement zone at the face side of the mat. The latex binder in the enhancement zone is typically cured by drying it from its water carrier by exposure to relatively high temperature air, e.g. about 350° F.

The slurry binder can wholly comprise starch or, more preferably, is used in an amount, for example, roughly equal by weight to the latex content. The latex binder enhancement zone or layer preferably uses the same latex material as used in the slurry but, if desired, can be different. The enhancement layer can be applied after the mat is fully cured and can be applied, if the mat or board is to be ground or sanded, after such grinding or sanding.

The latex enhancement zone can reduce manufacturing costs of the tile by allowing the latex content of the slurry to be reduced from that of conventional formulations. With the invention, the effective surface hardness of the face of the finished tile can be even higher than prior art products while the total or net latex usage is less than in such prior art products. The effective hardness of the tile face is measured through any finish material or paint coated and cured on the tile. The increased hardness of the outer face region, either on an absolute basis or as a comparison to prior art product, is reflected in a higher durability of the ceiling tile when it is being handled during installation or during its service life.

The latex enhancement zone is substantially more concentrated on the basis, for instance, of grams per unit of thickness than the remainder of the mat. By way of example, if the slurry carried latex binder content is about 4 or 5% of the weight of the mat distributed over the thickness of the mat proper, the enhancement zone, coated onto the top of the mat, can be about 1% of the total mat weight. Stated otherwise, in this example approximately ¼ to ⅕ of the latex binder content of the finished tile exists at one side of the mat when the latex binder enhancement zone is developed by a coating process. Ordinarily, the top side of the felted mat will be the side made with the supplemental latex binder enhancement zone since, in conventional felting or processing, this is the side which is most accessible. The zone is easily developed on the top of the mat by spraying, roll-coating or the like on the mat production line. When the latex enhanced zone is created by a separate coating process, the latex material used, as mentioned, is preferably the same as used in forming the mat slurry. This commonality affords convenience and cost savings through attendant purchasing, inventory and familiarity.

Ceiling tile of the type under consideration here is normally coated or painted to achieve a color that approaches a true white. This coating typically involves a primer coat and a finish coat of a formulation of a paint type latex with a fast low temperature cure. The invention enables the tile to be coated with less paint while achieving the same or improved whiteness. This effect results from the high concentration of latex binder present in the enhancement zone at the outer surface of the mat made under the principles of the invention which latex binder has a color closer to white than the color of natural mineral wool. The paint required on the face of the dried tile mat or board proper to hide the considerably off-white color of the mineral wool is reduced.

It has been found that the ceiling tile made in accordance with the invention can also exhibit improved sound absorption sometimes technically referenced as noise reduction coefficient (NRC). This phenomena is believed to be the result of using less paint or coating which, apparently, causes less net blocking of the porous surface of the mat and, therefore, promotes greater sound absorption.

The following table sets out an example of a solids formulation of a conventional prior art tile identified by the label "Control" and an example of a formulation of a tile of the invention identified by the label "Trial".

Formulation/Construction:

| | Wool % | Starch % | Latex in Core % | Latex Spray % | Total Latex % |
|---|---|---|---|---|---|
| Control | 92.3 | 3.0 | 6.7 | 0.0 | 6.7 |
| Trial | 92.3 | 3.0 | 4.7 | 1.0 | 5.7 |

Tiles of both formulations/constructions (Control) and (Trial) were tested with the following results:

Coating Coverage, Lab Value and Estimated NRC Value:

Test Run 1

| Test No. | Primary, GMs/SF | Finish, Gms/SF | Total Ctg, GM/SF | L | Lab Values a. | b. | Estimated NRC |
|---|---|---|---|---|---|---|---|
| Control | 20.0 | 20.0 | 40.0 | 93.69 | −0.19 | 3.87 | 0.67 |
| Trial 1 | 0.0 | 22.0 | 22.0 | 82.62 | 0.66 | 8.7 | 0.68 |
| Trial 2 | 11.0 | 20.0 | 31.0 | 90.11 | 0.02 | 4.35 | 0.72 |

-continued

| Test No. | Primary, GMs/SF | Finish, Gms/SF | Total Ctg, GM/SF | L | Lab Values a. | b. | Estimated NRC |
|---|---|---|---|---|---|---|---|
| Trial 3 | 10.0 | 10.0 | 20.0 | 87.56 | 0.09 | 5.04 | 0.70 |
| Trial 4 | 20.0 | 20.0 | 40.0 | 94.84 | −0.24 | 2.84 | 0.68 |

Test Run 2

| Test No. | Primary, GMs/SF | Finish, Gms/SF | Total Ctg, GM/SF | L | Lab Values a. | b. | Estimated NRC |
|---|---|---|---|---|---|---|---|
| Control | 20.0 | 20.0 | 40.0 | 92.48 | 0.02 | 4.15 | 0.69 |
| Trial 1 | 0.0 | 30.0 | 30.0 | 89.52 | 0.0 | 4.23 | 0.72 |
| Trial 2 | 20.0 | 15.0 | 35.0 | 91.07 | −0.15 | 3.78 | 0.73 |
| Trial 3 | 25.0 | 10.0 | 35.0 | 90.49 | −0.15 | 4.22 | 0.74 |
| Trial 4 | 0.0 | 26 | 26.0 | 87.81 | −0.2 | 6.83 | 0.74 |
| Trial 5 | 0.0 | 30.0 | 30.0 | 88.14 | −0.14 | 6.92 | 0.74 |
| Trial 6 | 35.0 | 0.0 | 35.0 | 86.84 | 0.55 | 7.84 | 0.67 |

Test Run 3

| Test No. | Primary, GMs/SF | Finish, Gms/SF | Total Ctg, GM/SF | L | Lab Values a. | b. | Estimated NRC |
|---|---|---|---|---|---|---|---|
| Control | 20.4 | 21.3 | 41.7 | 93.86 | −.20 | 3.54 | 0.69 |
| Trial 1 | 20.6 | 16.3 | 36.9 | 92.30 | −0.12 | 3.34 | 0.74 |
| Trial 2 | 20.6 | 18.0 | 38.6 | 92.83 | −0.11 | 3.06 | 0.73 |
| Trial 3 | 24.5 | 15.0 | 39.5 | 93.10 | −0.12 | 3.01 | 0.73 |
| Trial 4 | 0.0 | 33.0 | 33.0 | 91.78 | −0.19 | 3.71 | 0.67 |
| Trial 5 | 0.0 | 40.0 | 40.0 | 94.22 | −0.28 | 3.33 | 0.70 |
| Trial 6 | 20.4 | 21.3 | 41.7 | 93.88 | −0.26 | 2.93 | 0.73 |

Physical Data:

Test Run 1

| | Weight, LB/MSF | Caliper, inch | Density, LB/CF | HunterG, Hrdn's |
|---|---|---|---|---|
| Control | 1044 | 0.717 | 17.5 | 1.75 |
| Trial 1 | 1032 | 0.726 | 17.1 | 2.0 |
| Trial 2 | 1055 | 0.732 | 17.3 | 2.25 |
| Trial 4 | 1086 | 0.738 | 17.7 | 2.5 |

Test Run 2

| | Weight, LB/MSF | Caliper, inch | Density, LB/CF | HunterG, Hrdn's |
|---|---|---|---|---|
| Trial 1 | 1061 | 0.733 | 17.4 | 2.0 |
| Trial 2 | 1063 | 0.730 | 17.5 | 2.25 |
| Trial 3 | 1072 | 0.733 | 17.5 | 2.5 |
| Trial 4 | 1059 | 0.729 | 17.4 | 2.25 |
| Trial 5 | 1060 | 0.734 | 17.3 | 2.0 |
| Trial 6 | 1069 | 0.729 | 17.6 | 3.0 |

Test Run 3

| | Weight, LB/MSF | Caliper, inch | Density, LB/CF | HunterG, Hrdn's |
|---|---|---|---|---|
| Control | 1035 | 0.710 | 17.5 | 1.75 |
| Trial 1 | 1053 | 0.726 | 17.4 | 2.0 |
| Trial 2 | 1064 | 0.734 | 17.4 | 2.0 |
| Trial 3 | 1089 | 0.730 | 17.9 | 2.25 |
| Trial 4 | 1045 | 0.725 | 17.3 | 2.0 |
| Trial 5 | 1071 | 0.730 | 17.6 | 2.0 |
| Trial 6 | 1061 | 0.732 | 17.4 | 2.0 |

Trial 1, Trial 2 etc. are separate samples of the inventive formulation/constructions.

The tiles (Trial) made according to the invention were coated with finishing material (a latex-based paint) in various quantities of a primer coat and/or a finish coat. Paint grade latex is readily distinguishable on a mechanical strength basis and on an abrasion-resistance basis from a binder type latex material.

Study of the values recorded in the above tables reveals that ceiling tiles fabricated with a latex enhancement zone on the face of the mat according to the invention but with less total latex content can be whiter, capable of greater noise reduction, and more durable than tiles with a conventional formulation (Control).

A Hunter gauge (the source of the HunterG Hrdn's values) is a device used commercially to measure the surface hardness of materials such as wallboard. In general, the higher the Hunter gauge reading, the harder the surface of a product and the greater its durability.

The values L, a, b, are references to a color space method of evaluating the color of a surface wherein pure white is assigned the value of 100 and the lower the absolute value of the a, b values, the less deviation from white to primary colors. The greater the number recorded for NRC, the more a board is capable of absorbing sound.

Other methods can be developed to produce a latex enhancement zone in a ceiling tile mat besides those disclosed herein. For example, it is envisioned that such a zone can be developed in the felting process adjacent the screen by purposely allowing the latex to settle out or by depositing a high latex content onto the screen prior to the formation of the mat proper. Typically, a tile made in accordance with the invention will have a caliper of between about ½ to about ⅞" and will have a relatively porous interior.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A ceiling tile comprising a slurry formed mat of a nominal thickness of between about ½ inch and about ¾ inch and having at least 75% mineral wool content and 3% binder by weight, the binder being distributed substantially throughout the thickness of the mat and serving to rigidify the mineral wool fibers, and a binder enhancement zone on a face side of the mat, the zone having a binder content per unit thickness substantially greater than the binder content per unit thickness of a main portion of the mat whereby approximately ⅕ to ¼ of the total binder content is in the binder enhancement zone and the remaining respective approximately ⅘ to ¾ binder content is distributed in the mat out of the binder enhancement zone whereby the hardness of the zone is greater than the hardness of the main portion of the mat such that the durability of the tile in resisting physical damage is increased while the overall binder content of the tile can be reduced and consequently the costs of the tile can be reduced.

2. A ceiling tile as set forth in claim 1, wherein the binder enhancement zone is covered with a paint-type coating that is closer in color to a pure white than the color exhibited by the binder enhancement zone.

3. A ceiling tile as set forth in claim 2, wherein the binder enhancement zone includes a latex binder and is closer to a pure white in its color than the color of a main portion of the mat whereby less paint type coating is necessary to obtain a desired level of white color at the face of the tile than would be required if the binder enhancement zone was omitted and the paint type coating was applied to a face of the mat.

4. A ceiling tile as set forth in claim 1, wherein the binder enhancement zone is coated on the mat.

5. A ceiling tile comprising a base mat formed from a water slurry of uniformly mixed mineral wool and binder, the mineral wool forming the majority of the weight of the tile, the mat having a relatively low density and being relatively porous, a binder enhancement zone on a face side of the mat formed as a coat of binder on the body of mineral wool and binder from the slurry, the concentration of binder, that serves to hold the mineral wool together and rigidify it, per unit thickness in the binder enhancement zone being substantially greater than the concentration of binder in the mat per unit thickness whereby approximately ⅕ to ¼ of the total binder content is in the binder enhancement zone and the remaining respective approximately ⅘ to ¾ binder content is distributed in the mat out of the binder enhancement zone, the stratified binder distribution producing a higher NRC than a tile of like components but of uniform, greater total binder content.

6. A ceiling tile as set forth in claim 5, wherein the binder coated on the mat is the same as binder material mixed in the slurry to form said mat.

7. A ceiling tile as set forth in claim 5, wherein the binder enhancement zone is coated with a material to color the tile towards white.

8. A ceiling tile as set forth in claim 5, wherein the binder in the binder enhancement zone is a high Tg binder type latex.

* * * * *